US008779892B2

(12) United States Patent
Chen

(10) Patent No.: US 8,779,892 B2
(45) Date of Patent: Jul. 15, 2014

(54) WIRELESS ILLUMINATION CONTROLLER WITH THE FUNCTION TO SET THE LOWEST DRIVING POWER

(75) Inventor: Wen-Lin Chen, New Taipei (TW)

(73) Assignee: Arc Technology Co., Ltd., New Taipei (TW)

( * ) Notice: Subject to any disclaimer, the term of this patent is extended or adjusted under 35 U.S.C. 154(b) by 193 days.

(21) Appl. No.: 13/340,184

(22) Filed: Dec. 29, 2011

(65) Prior Publication Data

US 2013/0119885 A1 May 16, 2013

(30) Foreign Application Priority Data

Nov. 16, 2011 (TW) ..... 100221610 A

(51) Int. Cl.
*G08C 19/00* (2006.01)
*G08B 5/22* (2006.01)

(52) U.S. Cl.
USPC ..... 340/5.61; 340/4.61

(58) Field of Classification Search
USPC ..... 315/149–160; 340/4.41, 5.51, 5.23, 5.5, 340/5.6, 5.61, 5.62, 5.64
See application file for complete search history.

(56) References Cited

U.S. PATENT DOCUMENTS

| | | | | |
|---|---|---|---|---|
| 6,169,377 | B1 | 1/2001 | Bryde et al. | |
| 7,573,372 | B2 * | 8/2009 | Mogilner et al. | 340/12.32 |
| 7,693,610 | B2 * | 4/2010 | Ying | 700/295 |
| 7,970,408 | B2 * | 6/2011 | Vacon et al. | 455/446 |
| 2009/0108765 | A1 | 4/2009 | Weightman et al. | |
| 2010/0141153 | A1 * | 6/2010 | Recker et al. | 315/149 |
| 2010/0160759 | A1 * | 6/2010 | Celentano et al. | 600/365 |
| 2011/0121744 | A1 | 5/2011 | Salvestrini et al. | |
| 2011/0133655 | A1 * | 6/2011 | Recker et al. | 315/159 |
| 2011/0276193 | A1 * | 11/2011 | Bowman et al. | 700/295 |

* cited by examiner

*Primary Examiner* — Minh D A
(74) *Attorney, Agent, or Firm* — Birch, Stewart, Kolasch & Birch, LLP

(57) ABSTRACT

A wireless illumination controller with the function to set the lowest driving power includes a microprocessor, a driver, an illumination control switch, and a wireless receiving module. The microprocessor is built in with an adjustable lowest power and connected with the driver, the illumination control switch, the wireless receiving module and a power processing module. The illumination control switch is used to set the lowest power of the microprocessor. After the wireless receiving module receives a wireless illumination adjustment command, the power of the driving signal output from the driver is controlled to be not lower than the lowest power. Therefore, when a user adjusts the illumination, the driving power is never lower than the lowest driving power of the corresponding light bulb, thereby avoiding flickering.

28 Claims, 8 Drawing Sheets

WIRELESS ILLUMINATION CONTROLLER WITH THE FUNCTION TO SET THE LOWEST DRIVING POWER

BACKGROUND OF THE INVENTION

1. Field of the Invention

The invention relates to a wireless illumination controller and, in particular, to a wireless illumination controller with the function to set the lowest driving power for a user to tune to the lowest brightness of a light bulb. It can be flexibly applied to light bulbs of different brands without flickering.

2. Description of Related Art

People nowadays value life quality more. Home control systems have become more popular. One of the most commonly seen home control systems is the illumination controller. It is electrically connected with light bulbs at home for its user to adjust the brightness thereof. The user can thus increase the brightness of a light bulb during work or reading, whereas decrease the brightness of a light bulb before or during sleep.

The illumination controller is connected in series between the light bulbs and the AC power source. Whether adopting a variable resistor or a power gate element, it always comes with a knob for the user to adjust the brightness of light bulbs. The angular position of the knob is used to determine a corresponding resistance or the voltage phase of the AC power source, thereby adjusting the current or power of the circuit and thus the brightness desired by the user. There are many different light bulbs on the market. Energy-saving and LED light bulbs have gradually replaced conventional halogen light bulbs. Such light bulbs are equipped with a driving circuit. Therefore, a special illumination controller is required in order to properly adjust the brightness thereof. However, this is apparently inconvenient for users. When the special illumination controller is used on light bulbs of different brands or of same brand but of different powers, the problem of flickering may occur.

With reference to FIG. 8, the reason for the flickering is that light bulb A and light bulb B of different brands or different powers have different characteristic curves C1, C2. The driving powers $P_{L1}$ $P_{L2}$ for the respective lowest brightness (hereinafter referred to as the lowest driving power) are not consistent. Therefore, once the lowest driving power that can be output from a special illumination controller is lower than that of the current light bulb, the light bulb is likely to flicker when the user tunes the special illumination controller to its lowest driving power.

For example, suppose the user uses the illumination controller for light bulb B to adjust the brightness of light bulb A. Since the lowest driving power of C2 is lower than that of C1, there is no sufficient power to drive light bulb A when the user tunes the special illumination controller to the lowest power. Light bulb A thus flickers. In this case, the user has to tune up the special illumination controller in order to prevent the flickering. However, the user may think that either the special illumination controller or the light bulb is out of order and wants to replace it.

Suppose the user uses the illumination controller for light bulb A to adjust the brightness of light bulb B. Since the lowest driving power of C1 is higher than that of C2, the user cannot tune the special illumination controller for light bulb A to obtain the lowest brightness of light bulb B. The adjustable brightness range is thus limited. In summary, the above-mentioned drawbacks and problems occur if light bulbs are not associated with the corresponding illumination controller.

SUMMARY OF THE INVENTION

In view of the foregoing, an objective of the invention is to provide a wireless illumination controller with the function of setting the lowest driving power.

To achieve the above-mentioned objective, the wireless illumination controller with the function of setting the lowest driving power includes: a microprocess built in with an adjustable default lowest power; a driver connected with the microprocessor for the connection of an external light bulb and controlled by the microprocessor to output a corresponding driving signal; an illumination control switch connected with the microprocessor for a user to operate to set the lowest power of the microprocessor; and a wireless receiving module connected with the microprocessor, after receiving a wireless illumination adjustment command, to let the microprocessor control the driving signal output from the driver according to the wireless illumination adjustment command, wherein the power of the driving signal is no less than the lowest power.

The illumination control switch provides a function of setting the lowest power. After replacing with a light bulb of different brand or power, the user first uses the illumination control switch to set the lowest default power most suitable for the current light bulb. After receiving a wireless illumination adjustment command, the illumination controller does not provide a driving power lower than the lowest driving power of the light bulb, thereby preventing the flickering arising from insufficient driving power. As a result, the user can freely choose the same type of light bulb of a different brand. This is very convenient.

Another objective of the invention is to provide an illumination controller easy to set the lowest power. The microprocessor is directly built in with several different lowest power values. It is associated with a multi-step illumination control switch corresponding to the different lowest power values. The multi-step illumination control switch has a plurality of switch steps. The user switches among the switch steps to select different lowest power values as the lowest power of the microprocessor.

After replacing with a light bulb of a different brand or power, the user switches from a higher lowest power value to a lower lowest power value so that the microprocessor controls the driver to output a lower lowest driving power. If the light bulb does not flicker, then it means that the current driving power is still higher than the lowest driving power of the light bulb. The user can further switch to an even lower lowest driving power until the light bulb flickers. In this case, the user switches back to the previous one or stays at the last option. Once this is done, the microprocessor automatically sets the lower driving power on the switch as the lowest driving power for the light bulb. The user does not need to directly obtain the lowest driving power of the current light bulb. All subsequent illumination adjustments are thus ensured not to be lower than the lowest driving power set according to the invention.

DETAILED DESCRIPTION OF THE PREFERRED EMBODIMENT

Figure 1:
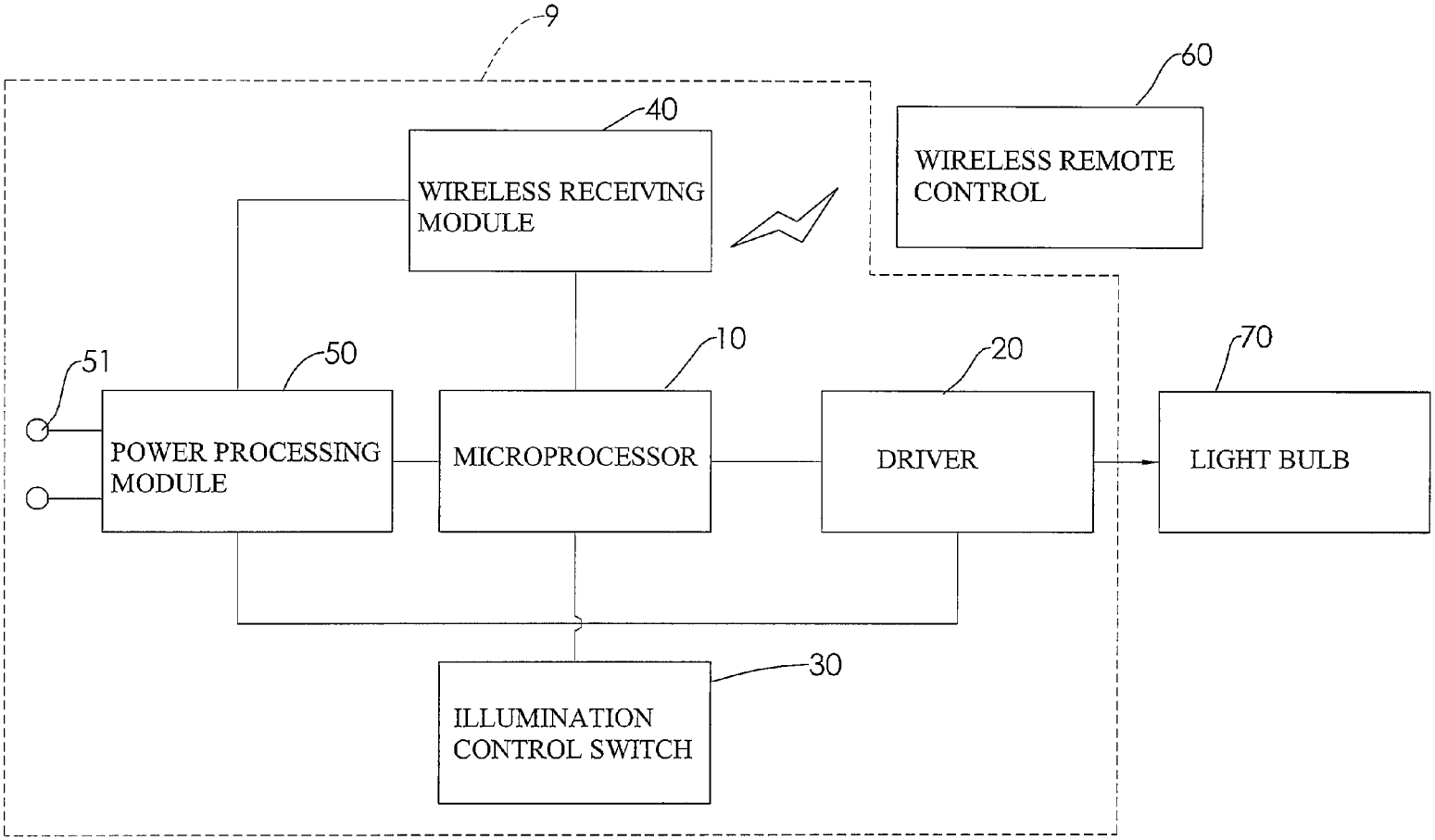
FIG. 1 is a block diagram of the invention.
Figure 2:
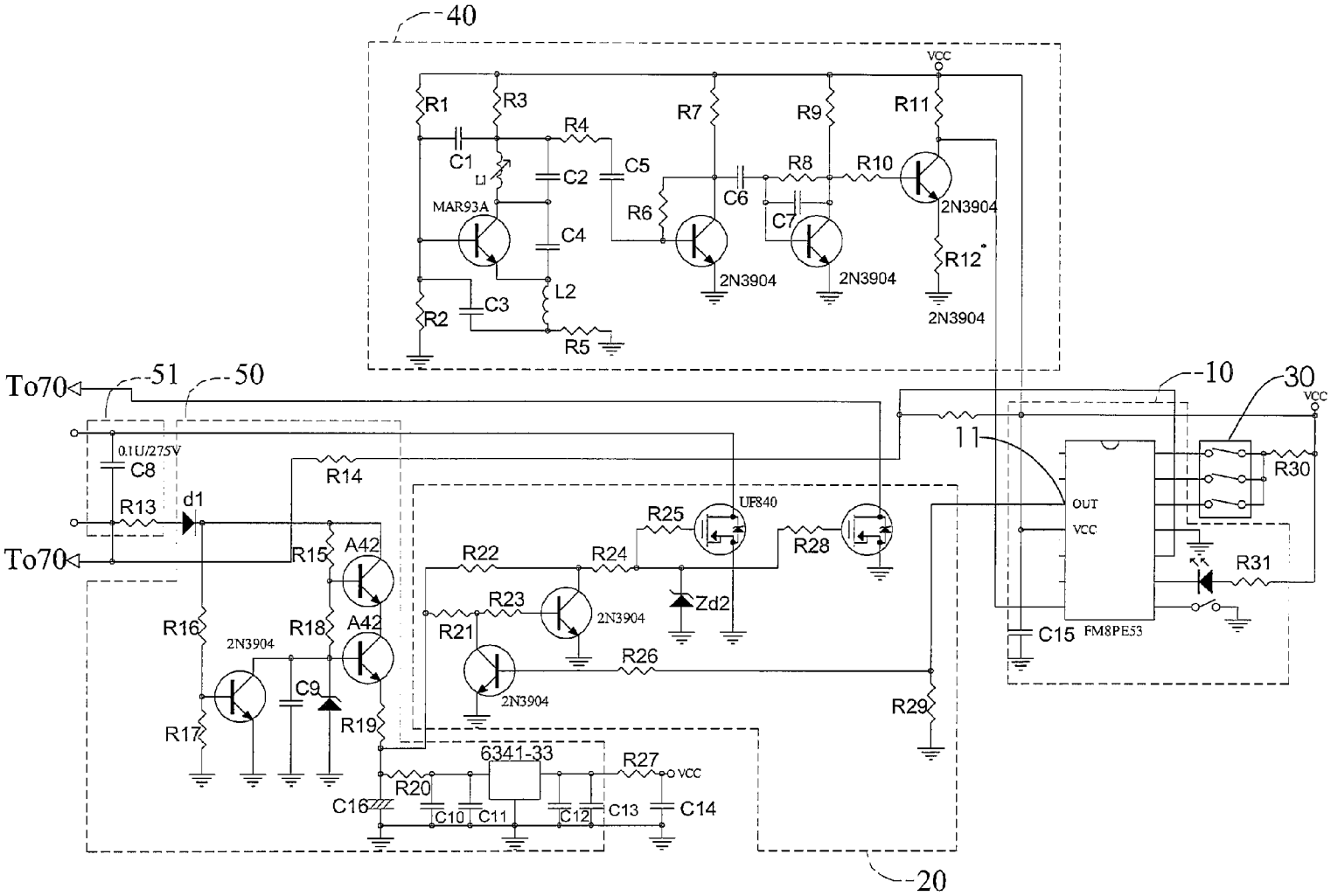
FIG. 2 is a detailed circuit diagram of the invention.

With reference to FIGS. 1 and 2, the wireless illumination controller 9 with the function of setting the lowest driving power includes a microprocessor 10, a driver 20, an illumination control switch 30, a wireless receiving module 40, a power processing module 50, and a wireless remote control 60.

The microprocessor 10 is built in with a designated default lowest power. In this embodiment, the microprocessor 10 further stores an illumination adjustment value.

The driver 20 is connected with the microprocessor 10 for the connection with an external light bulb 70. The driver 20 is controlled by the microprocessor 10 to output power corresponding to a driving signal. In this embodiment, the microprocessor 10 outputs PWM signals of different pulse widths to the driver 20, thereby controlling the magnitude of the power of the driving signal output by the driver 20.

The illumination control switch 30 is connected with the microprocessor 10 for a user to operate and set the lowest power of the microprocessor 10. In this embodiment, the illumination control switch 30 is implemented by a multi-step illumination control switch 31 with a knob 32.

The wireless receiving module 40 is connected with the microprocessor 10. After receiving a wireless illumination adjustment command, the microprocessor 10 controls the power of the driving signal output by the driver 20 according to the wireless illumination adjustment command. The power of the driving signal is no less than the lowest power.

The power processing module 50 has a set of power input terminals 51, and is connected with the microprocessor 10, the driver 20, and the wireless receiving module 40. The set of power input terminals 51 is connected to a household AC power source. The power processing module 50 then converts the household AC power source to the power required by the microprocessor 10, the driver 20, and the wireless receiving module 40.

The wireless remote control 60 is for the user to send the illumination adjustment command to the wireless receiving module 40.

The microprocessor 10 has a PWM signal output end 11. The driver 20 is connected to the PWM signal output terminal 11, so that the microprocessor 10 sends PWM signals of different pulse widths via the PWM output terminal 11 to the driver 20.

Figure 3:
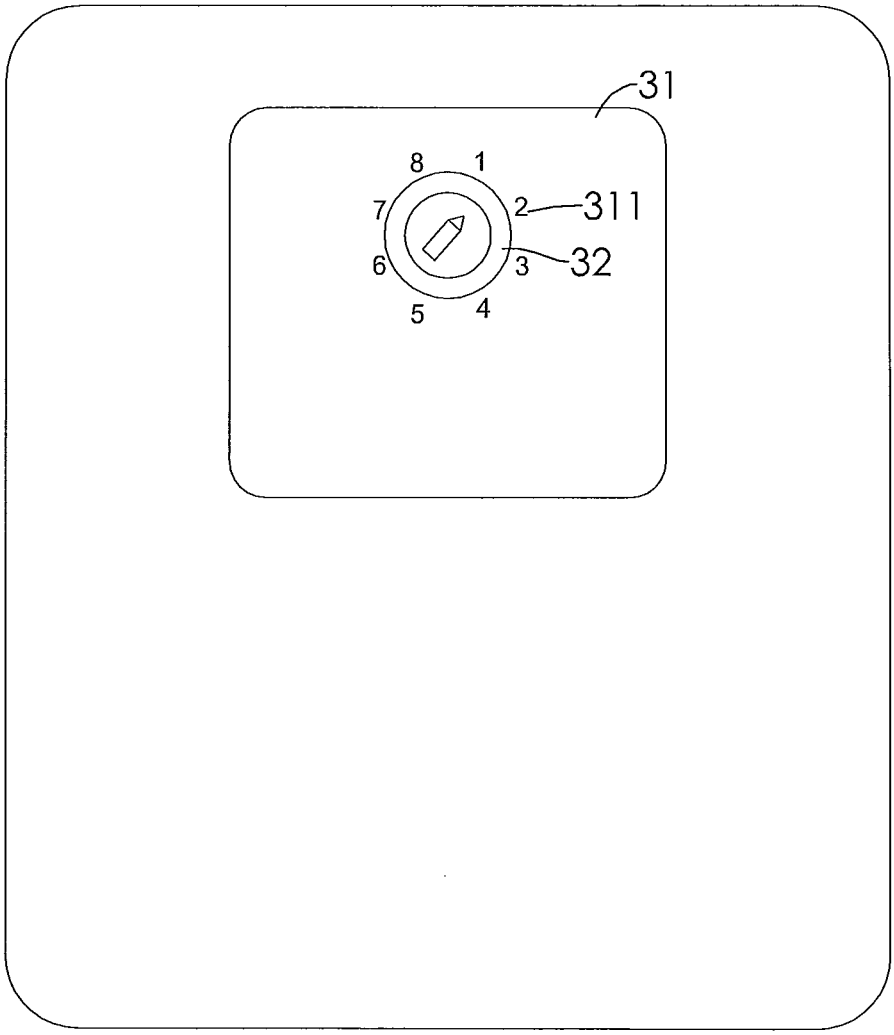
FIG. 3 is a planar view of a multi-step illumination control switch.

With reference to FIG. 3, the microprocessor 10 is directly built in with a plurality of different lowest power values and is accompanied with a multi-step illumination control switch 31 corresponding to the different lowest power values. The multi-step illumination control switch 31 has several switch steps 311 and a knob 32. The user uses the knob 32 to switch among the switch steps 311 in order to select one of the different lowest power values as the lowest power for the microprocessor 10.

Once the designated lowest power of the microprocessor 10 is changed to a new one, the driver 20 is controlled to output driving signals with power greater than or equal to the new lowest power. The user than observes whether the light bulb 70 flickers under the driving signal with power greater than or equal to the new lowest power.

The microprocessor 10 is further built in with an illumination adjustment procedure. The wireless illumination adjustment command contains an illumination adjustment initialization signal and an illumination adjustment confirmation signal. The microprocessor 10 receives the illumination adjustment initialization signal and the illumination adjustment confirmation signal emitted by the wireless remote control 60. After receiving the illumination adjustment initialization signal, the microprocessor 10 executes the illumination adjustment procedure to continuously adjust the power of the driving signal output by the driver 20. After receiving the illumination adjustment confirmation signal, the microprocessor 10 stops changing the power of the driving signal. The driving signal at the last moment is used as the output driving power.

Figure 4:
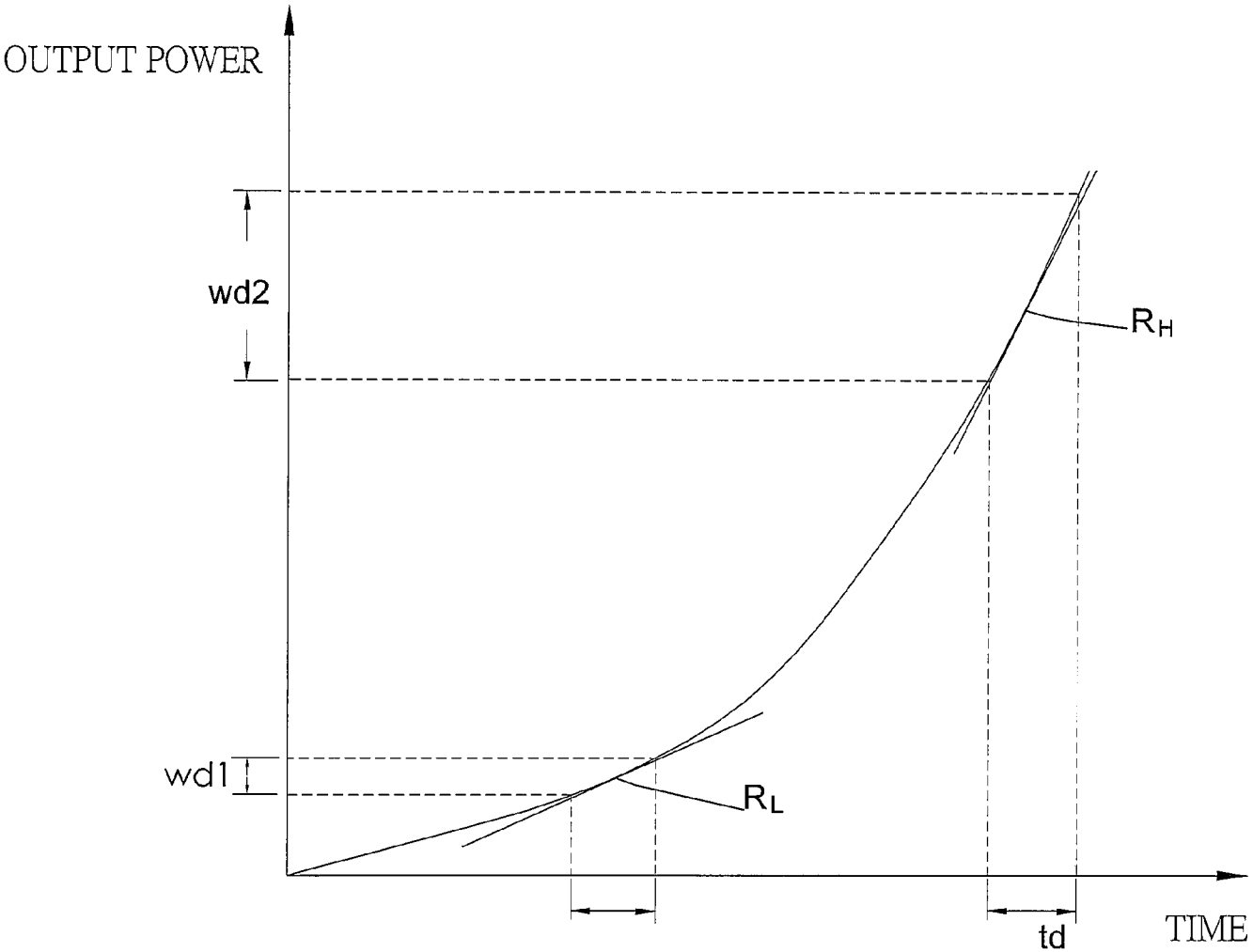
FIG. 4 is a plot showing the relation between the driving signal power and time according to a preferred embodiment of the illumination adjustment procedure.
Figure 8:
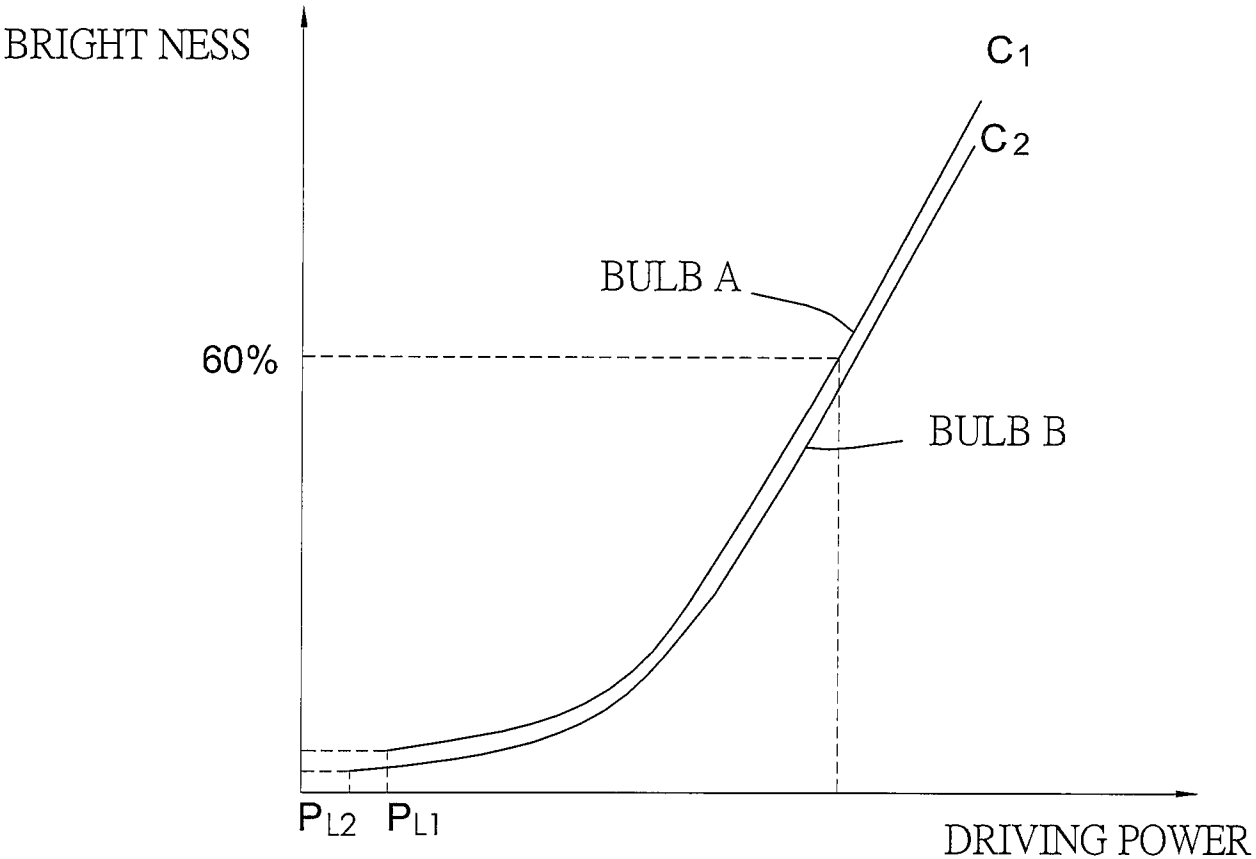
FIG. 8 is a plot showing the relation between brightness and power of energy-saving light bulbs of different brands.

With further reference to FIG. 4, the illumination adjustment procedure is built in with a high-speed varying rate $R_H$ and a low-speed varying rate $R_L$. The high-speed varying rate $R_H$ is used to make a larger change in the driving signal power in each unit time. The low-speed varying rate $R_L$ is used to make a smaller change in the driving signal power in each unit time. The low-speed varying rate $R_L$ corresponds to the low brightness range, so that the output signal power change in the low brightness range is adjusted at a lower rate. The high-speed varying rate $R_H$ corresponds to the high brightness range, so that the output signal power change in the high brightness range is adjusted at a higher rate. When a wireless illumination adjustment command is received to continuously adjust the brightness in the low brightness range, the low-speed varying rate $R_L$ is used to change the magnitude of the output signal power. Otherwise, the high-speed varying rate $R_H$ is used to change the magnitude of the output signal power. As shown in FIG. 8, the low brightness range and the high brightness range can be divided at 60% of the full brightness of the light bulb.

Figure 5:
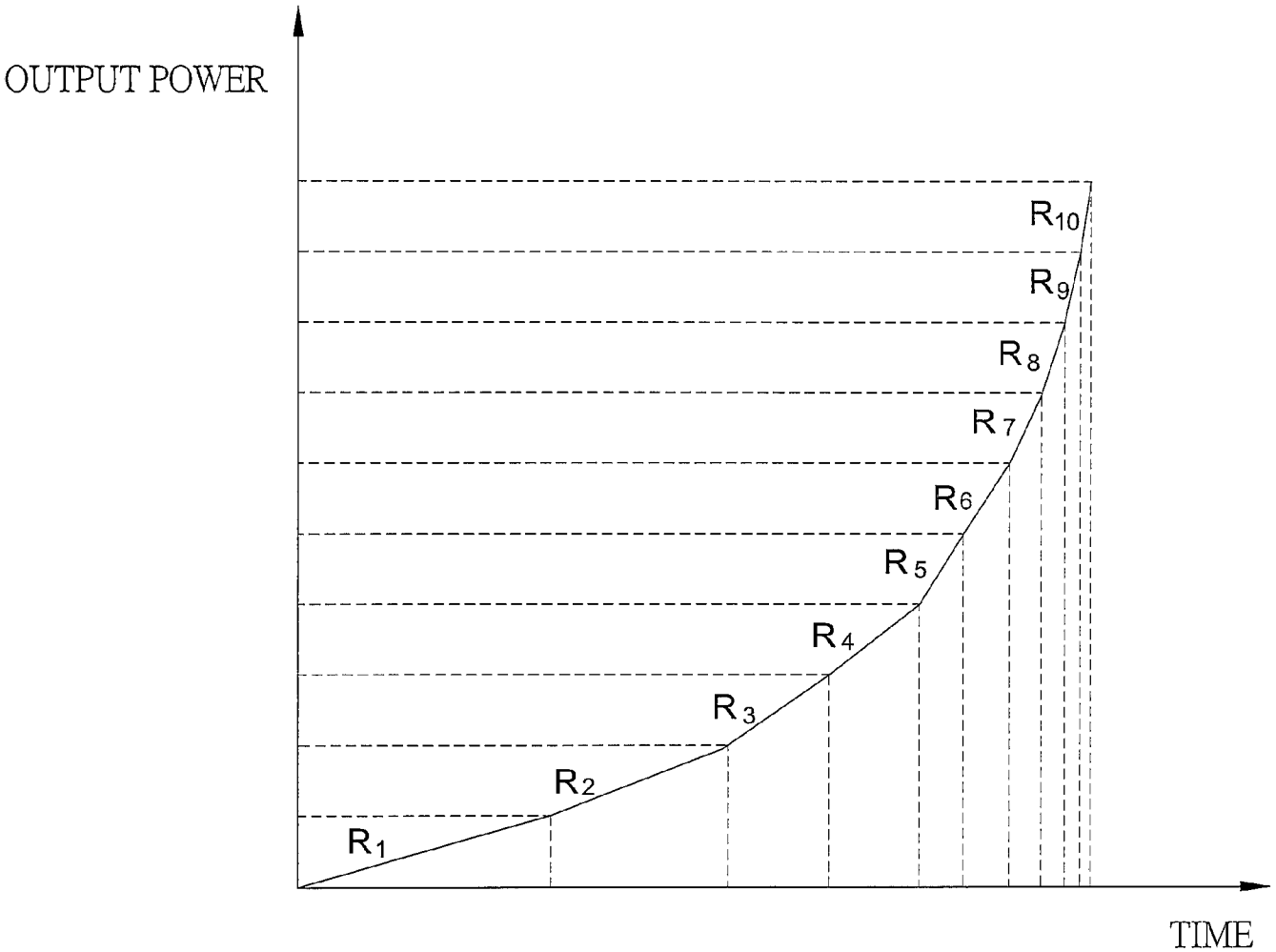
FIG. 5 is a plot showing the relation between the driving signal power and time according to another embodiment of the illumination adjustment procedure.

Since the brightness and power do not have a linear relation in the low brightness range, the illumination adjustment procedure can further include a plurality of different low-speed varying rates, each of which is smaller than the high-speed varying rate. As shown in FIG. 5, there are 6 low-speed varying rates R1~R6 and 4 high-speed varying rates R7~R10, wherein R1<R2< . . . <R10. When a wireless illumination adjustment command is received to continuously adjust the driving signal power in correspondence with the first power, the low-speed varying rate R1 is used to change the signal power. For the second power, the second low-speed varying rate R2 is used instead. The user thus uses the remote control to continuously vary the brightness of the light bulb 70 from low to high. Using different varying rates to change the driving signal power renders the variation in the light bulb brightness smoother for human eyes in view of the nonlinear characteristic relation between brightness and power. The user feels that the brightness change is uniform.

When the wireless illumination controller 9 is in use, the power input terminals 51 of the power processing module 50 are connected to a household AC power source. The driver 20 is connected with a light bulb 70, which can be an energy-saving light bulb, LED, or a halogen light bulb of any brand.

The user turns the knob 32 to the lowest of the lowest power switch step 311, such as the first switch step 311 marked by 1 in FIG. 3. In this case, the wireless illumination controller 9 sets that as the lowest power. Starting from the lowest power, the wireless illumination controller 9 gradually increases and outputs driving signals. The user then observes whether the light bulb 70 flickers. If flickering occurs, the user turns the knob 32 to select a higher lowest power switch step 311, such as the second switch step marked by 2, and further observes whether the light bulb 70 flickers. Once the light bulb does not flicker, it means that the user does not need to switch to other power lower than the currently-used lowest brightness power for the light bulb 70. The setting is simple and easy for users of all ages.

To adjust the illumination, the user operates the wireless remote control 60 to emit the illumination adjustment initialization signal. The illumination controller 9 then varies the brightness of the light bulb 70. Once the user feels the right brightness of the light bulb 70, he or she also uses the wireless remote control 60 to emit the illumination adjustment confirmation signal. The illumination controller 9 then maintains the light bulb 70 at the corresponding brightness. This completes the illumination adjustment process.

Figure 6:
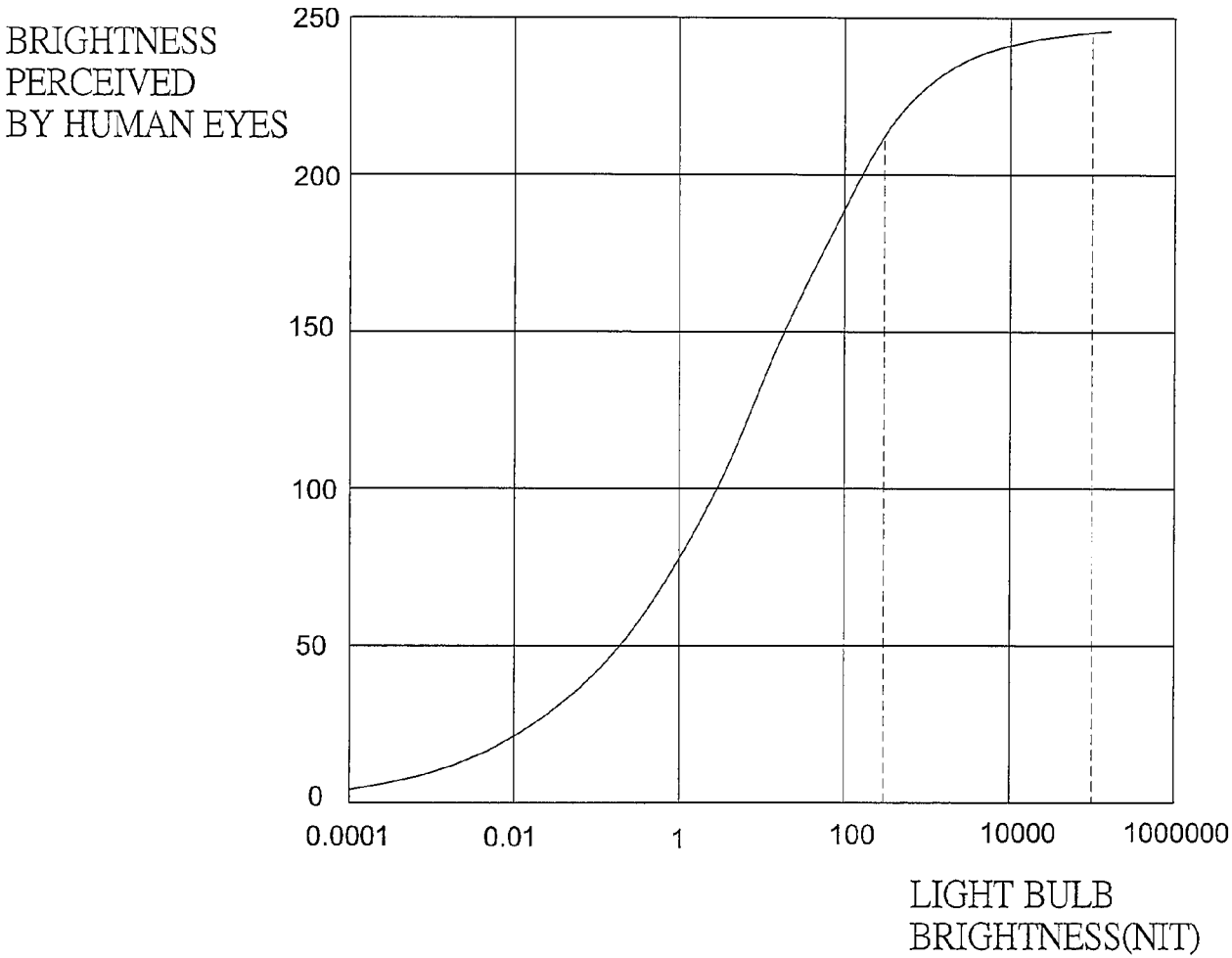
FIG. 6 is a plot showing the relation between the surface brightness of an object and the brightness perceived by human eyes.

With reference to FIG. 6, which shows the relation between the light bulb brightness and the brightness perceived by human eyes. For a usual light bulb for illumination, its surface brightness is between a few hundred and six thousand nit. As shown in the plot, the curve in that range has roughly a logarithmic relation. Therefore, human eyes can perceive the variation in brightness better when the light bulb surface brightness is low than when the brightness is high. Therefore, the illumination adjustment procedure in the low brightness range of the light bulb (i.e., when the driving signal power is below about 60% of the full brightness of the light bulb 70) has a smaller varying amount of the driving signal power in each unit time td. Thus, in the low brightness range of the light bulb 70, such as stages R1, R2, and R3 in FIG. 5, the adjusting time is longer. The user thus feels a smooth change in the brightness. There is more sufficient time for the user to decide whether the brightness is suitable. In the high brightness range of the light bulb (i.e., when the driving signal power is above about 60% of the full brightness of the light bulb 70), the varying amount of the driving signal power in each unit time td is larger. The adjusting time in the stages R7, R8, and R9 is shorter. The user thus better feels the change in the brightness of the light bulb 70.

Figure 7:
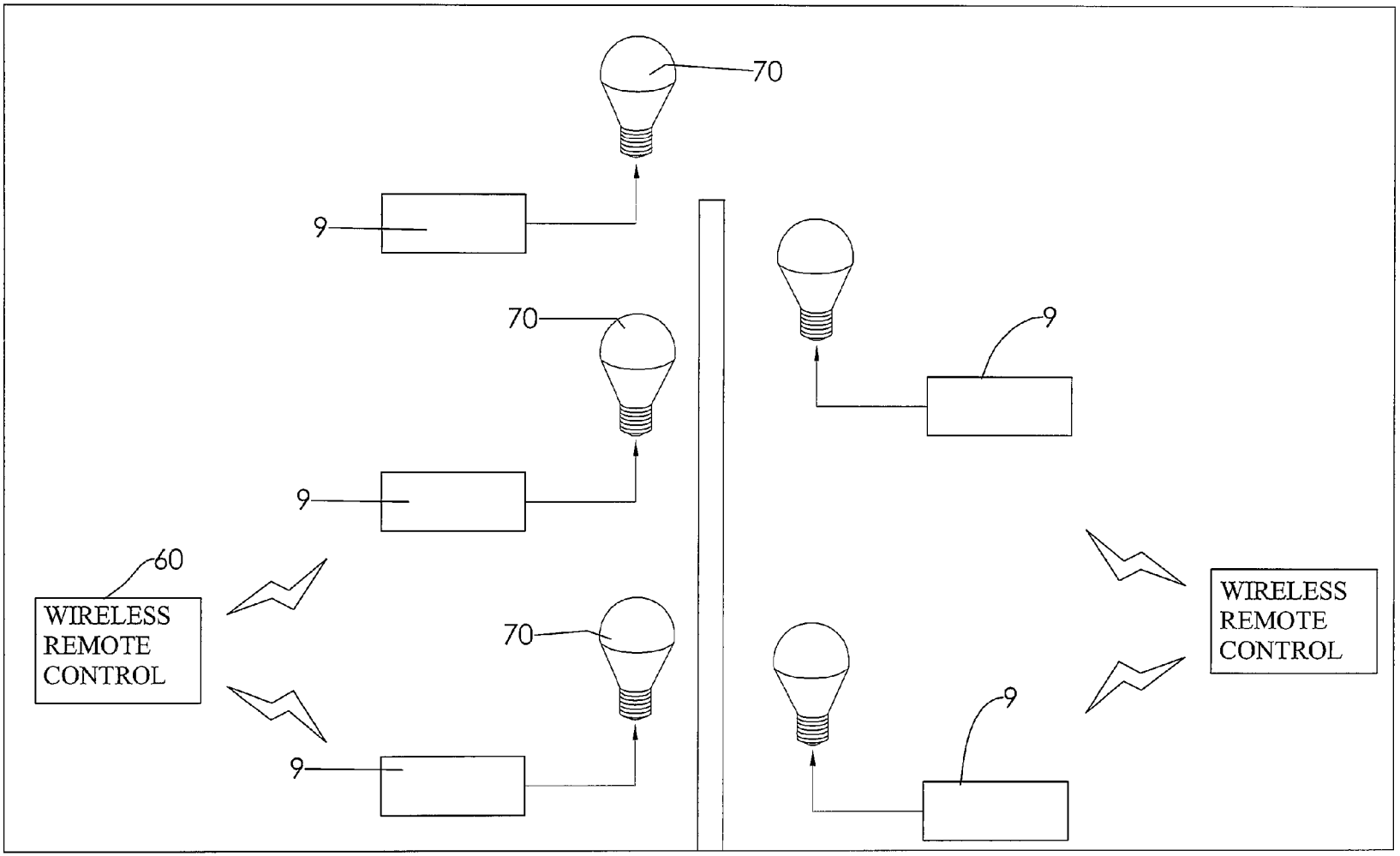
FIG. 7 is a schematic view showing the invention in use.

With further reference to FIG. 7, since the invention allows the user to use the wireless remote control, the invention can be used to control the atmosphere in a home control system. A room can be provided with a plurality of wireless illumination controllers 9, each of which is connected with one (or several) light bulb 70. The user can then use one wireless remote control 60 to send the wireless illumination adjustment command to the wireless illumination controllers, thereby simultaneously adjusting the brightness of the wireless illumination controllers 9. The user can set the illumination adjustment setting values of the microprocessors 10 of the wireless illumination controllers 9. Then he or she can use the wireless remote control 60 to control the wireless illumination controllers 9 to output driving signals according to the illumination adjustment setting values.

In summary, the invention enables a user to set the lowest default power. When the illumination controller is used on a light bulb with a higher lowest brightness power, the user can tune up the lowest power to prevent flickering in subsequent adjustments. When the illumination controller is used on a light bulb with a lower lowest brightness power, the user can reduce the lowest power to prevent flickering. The invention uses a knob for the user to operate. It is simple and easy for users of all ages.

What is claimed is:

1. A wireless illumination controller with a function of setting a lowest driving power for controlling a light bulb, comprising:

a microprocessor built in with a designated lowest power for preventing the light bulb from flickering;

a driver connected with and controlled by the microprocessor to output a driving signal for driving the light bulb with a corresponding power, wherein the driver is adapted to connect to the light bulb;

an illumination control switch connected with the microprocessor for a user to operate and set the designated lowest power of the microprocessor; and a wireless receiving module connected with the microprocessor for receiving a wireless illumination adjustment command;

wherein after receiving the wireless illumination adjustment command, the microprocessor controls the power of the driving signal for driving the light bulb to be no less than the designated lowest power.

2. The wireless illumination controller as claimed in claim 1, wherein the microprocessor is built in with a plurality of different lowest power values; and a multi-step illumination control switch corresponding to the different lowest power values is operated with the microprocessor and has a plurality of switch steps and a knob; the knob is used to select one of the lowest power values as the lowest power of the microprocessor.

3. The wireless illumination controller as claimed in claim 2, wherein the microprocessor is built in with an illumination adjustment procedure; the wireless illumination adjustment command includes an illumination adjustment initialization signal and an illumination adjustment confirmation signal; the microprocessor executes the illumination adjustment procedure to continuously vary the power of the driving signal output by the driver after receiving the illumination adjustment initialization signal to find a required power; and the microprocessor stops varying the power of the driving signal to continuously output the driving signal with the required power after receiving the illumination adjustment confirmation signal.

4. The wireless illumination controller as claimed in claim 3, wherein the illumination adjustment procedure is built in with:

a high-speed varying rate that is used to make a larger change to the power of the driving signal in each unit time and corresponds to a high brightness range; and a low-speed varying rate that is used to make a smaller change to the power of the driving signal in each unit time and corresponds to a low brightness range; and the low-speed varying rate is applied to change the power of the driving signal when the wireless illumination adjustment command is received for continuously adjusting the brightness in the low brightness range, otherwise the high-speed varying rate is employed to change the power of the driving signal in the high brightness range.

5. The wireless illumination controller as claimed in claim 4 further comprising a power processing module having power input terminals and connected with the microprocessor, the driver, and the wireless receiving module; wherein the power input terminals are connected to a household AC power source, and the power processing module converts the household AC power to the power required by the microprocessor, the driver, and the wireless receiving module; and a wireless remote control controllable by a user to send the wireless illumination adjustment command to the wireless receiving module.

6. The wireless illumination controller as claimed in claim 5, wherein the microprocessor outputs PWM signals of different pulse widths to the driver, thereby controlling the power of the driving signal output by the driver.

7. The wireless illumination controller as claimed in claim 6, wherein the microprocessor stores an illumination adjustment setting value.

8. The wireless illumination controller as claimed in claim 2 further comprising a power processing module having power input terminals and connected with the microprocessor, the driver, and the wireless receiving module; wherein the power input terminals are connected to a household AC power source, and the power processing module converts the household AC power to the power required by the microprocessor, the driver, and the wireless receiving module; and a wireless remote control controllable by a user to send the wireless illumination adjustment command to the wireless receiving module.

9. The wireless illumination controller as claimed in claim 8, wherein the microprocessor outputs PWM signals of different pulse widths to the driver, thereby controlling the power of the driving signal output by the driver.

10. The wireless illumination controller as claimed in claim 9, wherein the microprocessor stores an illumination adjustment setting value.

11. The wireless illumination controller as claimed in claim 2, wherein the microprocessor outputs pulse width modulation (PWM) signals of different pulse widths to the driver, thereby controlling the power of the driving signal output by the driver.

12. The wireless illumination controller as claimed in claim 11, wherein the microprocessor controls the driver to output the driving signals with power greater than or equal to the designated lowest power when the designated lowest power has been changed.

13. The wireless illumination controller as claimed in claim 12, wherein the microprocessor stores an illumination adjustment setting value.

14. The wireless illumination controller as claimed in claim 3 further comprising a power processing module having power input terminals and connected with the microprocessor, the driver, and the wireless receiving module; wherein the power input terminals are connected to a household AC power source, and the power processing module converts the household AC power to the power required by the microprocessor, the driver, and the wireless receiving module; and a wireless remote control controllable by a user to send the wireless illumination adjustment command to the wireless receiving module.

15. The wireless illumination controller as claimed in claim 14, wherein the microprocessor outputs PWM signals of different pulse widths to the driver, thereby controlling the power of the driving signal output by the driver.

16. The wireless illumination controller as claimed in claim 15, wherein the microprocessor stores an illumination adjustment setting value.

17. The wireless illumination controller as claimed in claim 3, wherein the microprocessor outputs pulse width modulation (PWM) signals of different pulse widths to the driver, thereby controlling the power of the driving signal output by the driver.

18. The wireless illumination controller as claimed in claim 17, wherein the microprocessor controls the driver to output the driving signals with power greater than or equal to the designated lowest power when the designated lowest power has been changed.

19. The wireless illumination controller as claimed in claim 18, wherein the microprocessor stores an illumination adjustment setting value.

20. The wireless illumination controller as claimed in claim 4, wherein the microprocessor outputs pulse width modulation (PWM) signals of different pulse widths to the driver, thereby controlling the power of the driving signal output by the driver.

21. The wireless illumination controller as claimed in claim 20, wherein the microprocessor controls the driver to output the driving signals with power greater than or equal to the designated lowest power when the designated lowest power has been changed.

22. The wireless illumination controller as claimed in claim 21, wherein the microprocessor stores an illumination adjustment setting value.

23. The wireless illumination controller as claimed in claim 1 further comprising a power processing module having power input terminals and connected with the microprocessor, the driver, and the wireless receiving module; wherein the power input terminals are connected to a household AC power source, and the power processing module converts the household AC power to the power required by the microprocessor, the driver, and the wireless receiving module; and a wireless remote control controllable by a user to send the wireless illumination adjustment command to the wireless receiving module.

24. The wireless illumination controller as claimed in claim 23, wherein the microprocessor outputs PWM signals of different pulse widths to the driver, thereby controlling the power of the driving signal output by the driver.

25. The wireless illumination controller as claimed in claim 24, wherein the microprocessor stores an illumination adjustment setting value.

26. The wireless illumination controller as claimed in claim 1, wherein the microprocessor outputs pulse width modulation (PWM) signals of different pulse widths to the driver, thereby controlling the power of the driving signal output by the driver.

27. The wireless illumination controller as claimed in claim 26, wherein the microprocessor controls the driver to output the driving signals with power greater than or equal to the designated lowest power when the designated lowest power has been changed.

28. The wireless illumination controller as claimed in claim 27, wherein the microprocessor stores an illumination adjustment setting value.

* * * * *